US005100525A

United States Patent [19]

Pohto et al.

[11] Patent Number: 5,100,525

[45] Date of Patent: Mar. 31, 1992

[54] SPRING SUPPORTED ANODE

[75] Inventors: Gerald R. Pohto, Mentor; Charles P. Tomba, Painesville; Thomas A. Liederbach, Gates Mills; Edmund L. Cimino, Chesterland, all of Ohio

[73] Assignee: Eltech Systems Corporation, Boca Raton, Fla.

[21] Appl. No.: 557,348

[22] Filed: Jul. 25, 1990

[51] Int. Cl.[5] ..... C25B 11/03; C25B 11/02

[52] U.S. Cl. ..... 204/242; 204/280; 204/284; 204/286; 204/297 R; 267/160; 267/181

[58] Field of Search ..... 204/280, 286, 242, 288, 204/297 R, 284, 290 R, 95; 269/294; 267/158, 181, 160; 219/158, 161

[56] References Cited

U.S. PATENT DOCUMENTS

| | | | |
|---|---|---|---|
| 3,674,676 | 7/1972 | Fogelman | 204/286 |
| 4,028,214 | 7/1977 | Ford et al. | 204/286 |
| 4,033,849 | 7/1977 | Pohto et al. | 204/286 |
| 4,096,054 | 6/1978 | Specht et al. | 204/263 |
| 4,120,773 | 10/1978 | Ridgway | 204/252 |
| 4,129,292 | 12/1978 | Pohto et al. | 269/126 |
| 4,154,667 | 5/1979 | Pohto et al. | 204/286 |
| 4,231,143 | 11/1980 | Pohto et al. | 29/281.5 |

FOREIGN PATENT DOCUMENTS

| | | | |
|---|---|---|---|
| 0182980 | 10/1984 | Japan | 204/282 |

*Primary Examiner*—John Niebling
*Assistant Examiner*—Kathryn Gorgos
*Attorney, Agent, or Firm*—John J. Freer

[57] ABSTRACT

The present invention resides in an expandable anode assembly which comprises an anode riser and anode surfaces on opposite sides of the anode riser. Each anode surface comprises multiple anode sheets. Each anode sheet is supported by spring connectors which allow movement of one sheet of an anode surface without movement of the other sheet of such surface. The spring connectors hold each sheet so that its profile remains essentially flat in such movement. Each sheet lies in the same or an essentially parallel plane with other sheets of the anode assembly.

24 Claims, 3 Drawing Sheets

SPRING SUPPORTED ANODE

BACKGROUND OF THE INVENTION

1. Technical Field

The present invention relates generally to the art of electrolytic cells, and particularly to an expandable electrode for such cells. The present invention will be described with reference to an expandable anode for an electrolytic cell, although it will be apparent to those skilled in the art that the principles of the present invention are also applicable to the construction of an expandable cathode.

2. Description of the Prior Art

The use of expandable electrodes is well known in chlorine and caustic producing electrolytic cells. In such cells, the electrolyte has a high electrical resistance. For this reason, the gap between the anode and the adjacent cathode should be as small as possible. Cathodes in commercial electrolytic cells are typically very large. A cathode may have an overall height of about two feet. The cathode, which can as an example be a steel screen, may become misshapen and distorted through use and with age. This presents an irregular surface. The cathode can be out, from top to bottom, as much as one half inch. Also, the thickness of a coating on the cathode can vary. This has, in the past, prevented placing the cathode and anode close together, for instance, less than about one-half inch apart.

U.S. Pat. No. 3,674,676 discloses an anode assembly which comprises at least two opposed working faces on opposite sides of an anode riser. Supporting expandable or contractible springs connect the anode working faces, both mechanically and electrically, to the anode riser and hold the working faces spaced away from the riser. During assembly of an electrolytic cell, or replacement of an anode assembly, the anode assembly is contracted so that the anode working faces are relatively close to the anode riser. When the anode assembly is inserted into a cell, a working face may be on the order of about one-half inch from an adjacent cathode. After insertion of the anode assembly into a cell, the assembly is caused or allowed to expand, substantially reducing the gap between an anode working face and an adjacent cathode. The anode assembly of U.S. Pat. No. 3,674,676, is often referred to as a "minimum-gap" anode.

The '676 patent, in an embodiment, discloses an expandable anode assembly in which each anode working face is present in two sections separated by a gap. Thus the anode comprises four working faces, two on each side of the riser. Each face is connected to the riser by a single spring arm. The spring arm is connected to each face through a series of aligned resistance welds. This maintains each face generally parallel with the anode riser, at least along the weld line. However, pressure on an anode face at a point removed from the line of resistance welds, caused for instance by an extreme curvature in the cathode, can force the anode face to rotate. This will create a variable gap between the anode face and the cathode, resulting in a poor current distribution across the anode face, and overloading of an area or areas of the face.

U.S. Pat. No. 4,033,849 also discloses a "minimum-gap" anode assembly. The anode assembly comprises spring connectors between the riser and the anode working faces. Each anode working face is connected to the riser by two connectors which extend outwardly from the riser. The connectors are thus attached to an anode working face at spaced apart locations on opposite sides of the riser. The connectors have a bent configuration and are under compression. The tendency of each connector is to expand from its bent configuration. This maintains each anode working face, in the space between the points of attachment of the connectors to the anode working face, under tension, which in turn keeps the working faces generally planar. The component parts are dimensioned so that each anode working face is under tension when the anode is in an expanded state, as well as in a contracted state.

U.S. Pat. Nos. 4,129,292 and 4,231,143 disclose subject matters related to that of U.S. Pat. No. 4,033,849.

U.S. Pat. No. 4,154,667 discloses a method for converting a conventional box-type anode of an older chlorine or caustic electrolytic cell to an expandable "minimum-gap" anode.

Other patents showing related prior art are U.S. Pat. Nos. 4,120,773; 4,096,054; and 4,028,214.

SUMMARY OF THE INVENTION

The present invention resides in an expandable electrode assembly which comprises an electrode riser and active electrode surfaces on opposite sides of the electrode riser. Each electrode surface comprises multiple electrode sheets, e.g., a pair of electrode sheets. Each electrode sheet is supported by multiple spring connectors, e.g., a pair of connectors, which allow movement of one sheet of an electrode surface without movement of the other sheet of such surface. The spring connectors are deformable in essentially the same direction and hold each sheet so that its profile remain essentially flat in such movement. Each sheet lies in the same or an essentially parallel plane with other sheets of the anode assembly.

Preferably, the spring connectors are in the shape of a leaf spring. Each electrode sheet is supported by two spaced-apart leaf spring connectors which have a dimension substantially coextensive with the electrode sheet. Each spring connector is attached to an electrode sheet along a weld line comprising a plurality of weld points. The weld line connecting one spring connector to an electrode sheet is parallel to the weld line connecting the other spring connector to the electrode sheet. The leaf spring connectors are configured and the weld lines are spaced relatively close to the edges of the electrode sheet so as to hold the electrode sheet in its flat profile.

The first leaf spring connector extends from the riser to the electrode sheet. The second leaf spring connector extends between the sheet of one surface, on one side of the riser, and a sheet of the opposite surface, on the opposite side of the riser. Preferably, the spring connectors are perforate, or made of an expanded metal mesh. The connectors are welded, for instance by resistance welding, to the riser and anode sheets at a plurality of resistance weld points defining parallel lines of connections essentially coextensive with the width of each sheet.

BRIEF DESCRIPTION OF THE DRAWINGS

Further features of the present invention will become apparent to those skilled in the art to which the present invention relates from reading the following specification with reference to the accompanying drawings in which.

DESCRIPTION OF THE PREFERRED EMBODIMENTS

Figure 2:
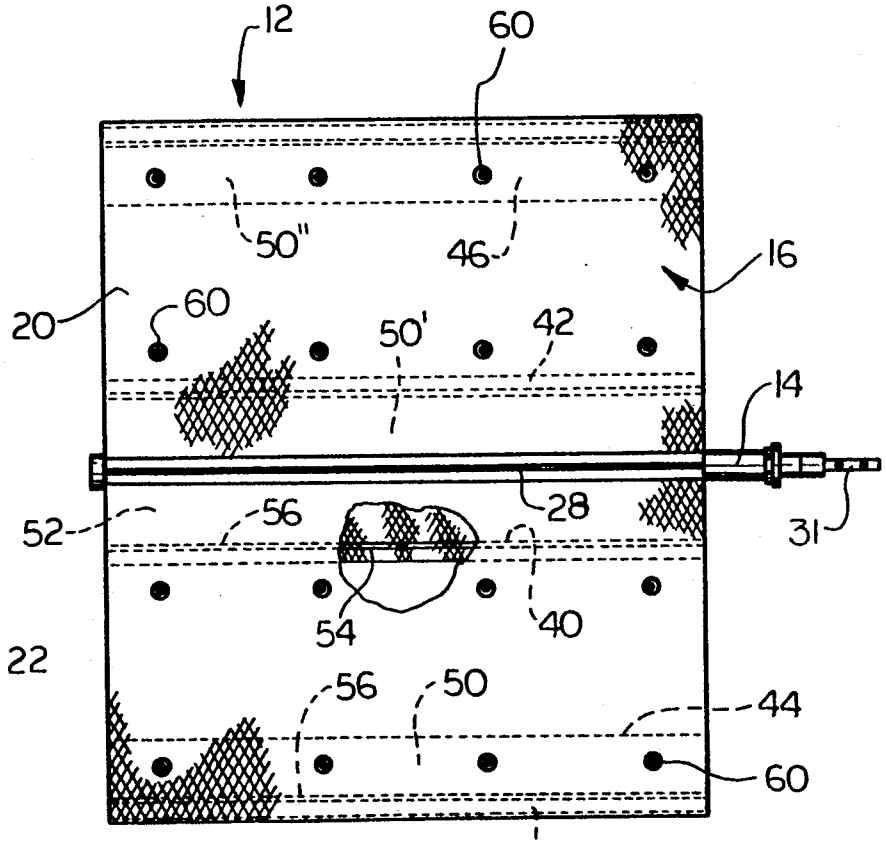
FIG. 2 is an elevation view of the anode assembly of FIG. 1.
Figure 1:
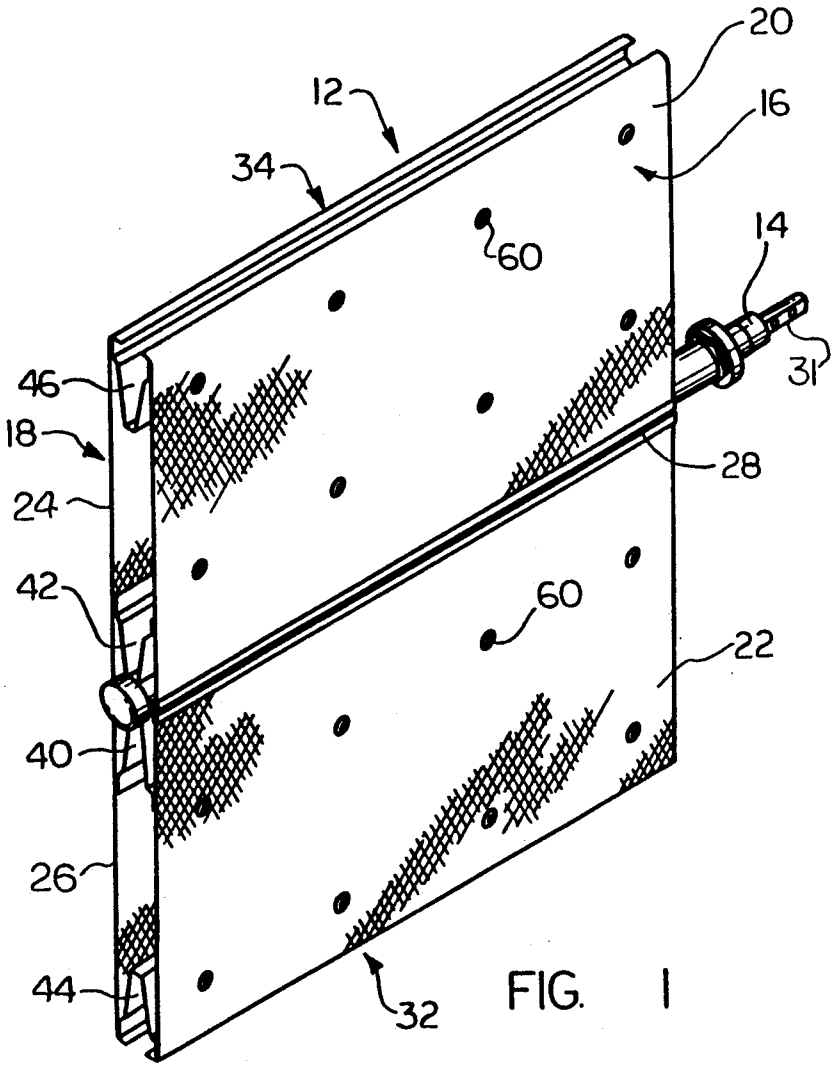
FIG. 1 is a perspective view of an anode assembly in accordance with the present invention.
Figure 3:
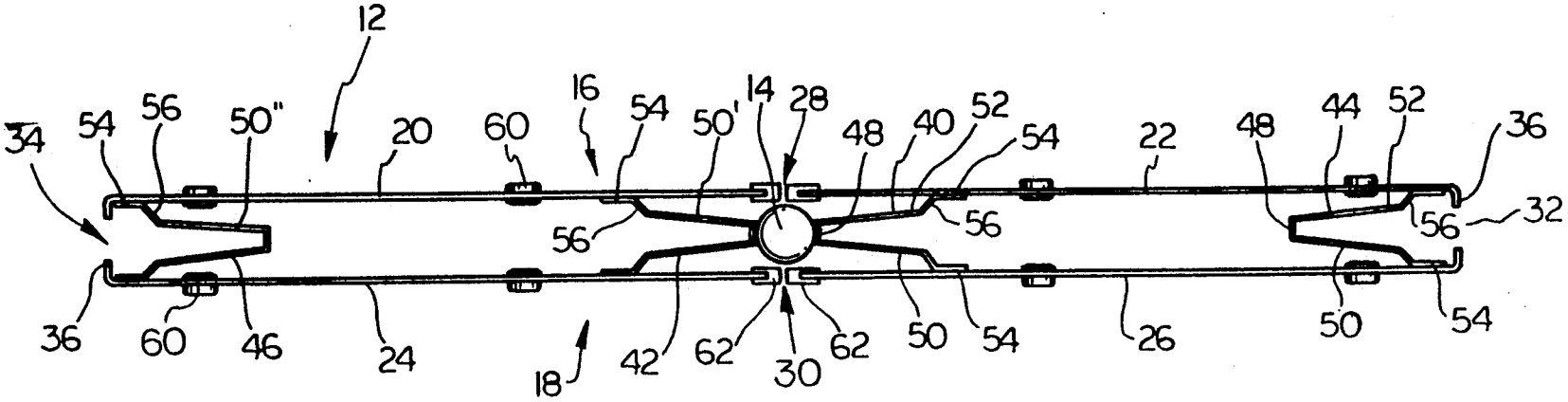
FIG. 3 is an enlarged plan view of the anode of FIG. 1.

Referring to FIGS. 1-3, the anode assembly 12 comprises a riser 14. The riser 14 has, on opposite sides, a first active anode surface 16 and a second active anode surface 18 (FIGS. 1 and 3). The anode assembly 12 is supported, with respect to the riser, so that the active anode surfaces 16, 18 are movable away from each other, to expand the anode assembly, and towards each other, to contract the anode assembly. The anode assembly 12 of FIGS. 1-3 is adapted to be positioned within an electrolytic cell between spaced-apart cathodes. The dimensions of the anode assembly 12, allow the anode assembly to be expanded, when positioned between cathode surfaces, a sufficient amount so that the active anode surfaces 16, 18 are essentially contiguous with the cathodes, establishing essentially a "minimum-gap".

The first active anode surface 16 comprises a pair of anode sheets 20, 22, and the second active anode surface 18 comprises a pair of anode sheets 24, 26 (FIGS. 1 and 3). All of the sheets 20, 22, 24 and 26 have a rectangular shape, and essentially the same width and height dimensions. For purposes of the present application, the width dimension of each anode sheet is essentially that dimension which extends parallel to the riser 14, and the height dimension is that dimension which extends perpendicular to the riser. All of the sheets 20, 22, 24 and 26 have a generally flat or planar profile. In the drawings of FIGS. 1-3, the sheets 20, 22, of the first active anode surface 16 lie in the same plane, and the anode sheets 24, 26, of the second active anode surface 18, lie in the same plane. The plane of sheets 24, 26 is parallel with the plane of sheets 20, 22. The anode sheets 20, 22 are spaced from each other by a gap 28, and the sheets 24, 26 are spaced from each by a gap 30 (FIG. 3).

In the embodiment of FIGS. 1-3, the anode assembly 12 is mounted in an electrolytic cell so that the riser 14 is fastened to a side wall of the cell at end 31, FIGS. 1, 2. Thus, the anode sheets 22 and 26 (FIG. 1) extend widthwise across the cell adjacent the bottom of the cell, and define the bottom 32 of the anode assembly. The anode sheets 20 and 24 (FIG. 1) of the anode assembly extend widthwise across the cell adjacent the top of the cell, and define the top 34 of the anode assembly. It will be apparent to those skilled in the art that other cell configurations are within the scope of the present invention. For instance, the riser 14 can be mounted in the bottom of the cell and extend vertically in the cell.

The anode sheets 20, 22, 24 and 26 can be formed from many different materials and have a variety of types of electrically conductive surfaces carried thereon. In the embodiment of FIGS. 1-3, the sheets comprise a substrate of titanium which is expanded or perforated to form a mesh-like member, as shown in FIGS. 1-3. Typically, approximately one-half of the total area of a sheet is open. The entire area of each sheet preferably is perforated or expanded uniformly.

The coated anode sheets are inert in the electrolytic process with which they are used and frequently referred to as dimensionally stable. In this respect, the anodes are not sacrificial or consumed in the process. The anodes usually comprise a substrate or base which is formed of a valve metal, such as titanium, tantalum, zirconium, aluminum, niobium and tungsten. These base metals are resistant to electrolytes and conditions used within electrolytic cells. A preferred valve metal is titanium. Titanium can be oxidized on its surface increasing the resistance of the valve metal to the passage of current. Therefore, it is customary to apply electrically conductive electro-catalytic coatings to the electrode substrate. The coatings have the capacity to continue to conduct current to the electrolyte over long periods of time without becoming passivated. Such coatings can contain catalytic metals or oxides from the platinum group metals such as platinum, palladium, iridium, ruthenium, rhodium and osmium. The coating also preferably contains a binding or protective agent such as oxides of titanium or tantalum, or other valve metals in sufficient amount to protect the platinum group metal or oxide from being removed from the electrode in the electrolysis process and to bind the platinum group metal or oxide to the electrode base. An example of one such dimensionally stable anode is a titanium substrate which has been coated with an electrocatalytic coating containing ruthenium and titanium.

The anode sheets 20, 22, 24 and 26 are supported in a manner which permits them to move such as by floating, between expanded and contracted conditions of the anode assembly 12. In the drawings of FIGS. 1-3, the anode assembly is shown in an expanded condition, so that the plane of sheets 20, 22 is spaced away from the riser 14, as is the plane of sheets 24, 26. In a contracted condition, the sheets 20, 22 would be pressed inwardly against the riser, as would sheets 24, 26. It is not necessary for the anode assembly 12 to be expandable or contractible a substantial distance. It is contemplated that the assembly normal condition will be in an expanded state, and that the assembly need be contracted only an amount which allows such assembly to be inserted into a space between a pair of cathodes of an electrolytic cell. However, the assembly normal condition can be in a contracted state and expanders can be used to expand the assembly after insertion in an electrolytic cell, in a manner known in the art.

By the term "floatingly movable", it is meant that each anode sheet is supported by spring connectors to be described, which allow movement of one sheet of an anode surface without movement of the other sheet of such surface. In addition, the spring connectors hold each sheet so that its profile remains essentially flat in such movement, and so that each sheet lies in the same or an essentially parallel plane with other sheets of the anode assembly during such movement.

For this purpose, each anode sheet 20, 22, 24, 26 is supported at two locations in the nature of a truss support for each sheet. A truss support is defined as an assemblage of members such as beams, which form a rigid framework. Referring to FIGS. 2 or 3, the spring connectors comprise a first pair of support connectors 40, 42 and a second pair of support connectors 44, 46. The first pair of support connectors 40, 42 are affixed to the riser 14 on opposite sides of the riser. The connectors 40, 42 are leaf connectors or a form of a leaf spring. In the embodiment illustrated, the connectors 40, 42 are generally V-shaped and have a flat mid-portion 48 (FIG. 3) which is affixed to the riser 14, and a pair of leaf arms 50, 52. The leaf arms 50, 52 are integral with the mid-portion 48, and extend outwardly from the riser 14. Each leaf arm 50, 52 has a flattened end 54, FIG. 3. The connectors 40, 42 are attached at flattened ends 54 to the inside of anode sheets 20, 22, 24 and 26. Thus, connector 42 is attached to anode sheets 20, 24 (see FIG. 3), and connector 40 is attached to anode sheets 22, 26.

The second pair of support connectors 44 and 46 are also leaf connectors or a form of a leaf spring. Referring to FIG. 3, the connectors 44, 46 are also V-shaped and preferably have the same configuration as connectors 40, 42. The second pair of support connectors 44, 46 are spaced outwardly away from riser 14. The second pair of connectors 44, 46 also have a flat mid-portion 48, a pair of leaf arms 50, 52, and flattened ends 54. In contrast to the first pair of connectors 40, 42, the second pair of support connectors 44, 46 are not fastened to anything at the mid-portion 48, but similar to connectors 40, 42, extend between oppositely positioned anode sheets. Thus, support connector 44 extends between and is connected to anode sheets 22, 26 and support connector 46 extends between and is connected to anode sheets 20, 24.

As shown in FIG. 2, by dashed lines, each of the support connectors 40, 42, 44 and 46 extends the full width of each anode sheet to which it is attached. The attachment of the support connector flattened ends 54 to the anode sheets is by a plurality of aligned spaced-apart spot welds, achieved, for instance by resistance welding. The attachment of the mid-portions 48 of the first pair o connectors 40, 42 to the riser 14 is similarly by a plurality of aligned spaced-apart spot welds, achieved, for instance, by resistance welding. The criteria for the number of welds and spacing is primarily good electrical connection between the respective components, and mechanical strength of the connection between the respective components. The plurality of welds between the respective components lie in a plurality of straight weld lines which are parallel to each other and, in the embodiment of FIGS. 1-3, to the axis of riser 14. It will be apparent from FIG. 3 that the spring connectors 40, 42, 44 and 46 are all deformable in essentially the same direction, namely in a direction which is at right angles to the axis of riser 14, and also at right angles to the planes of the multiple anode sheets 20, 22, 24 and 26.

As shown in FIG. 2, by a partially broken away area, the connectors 40, 42, 44 and 46 are made of an expanded or perforate mesh, similar to the mesh of anode sheets 20, 22, 24 and 26. In contrast with the anode sheets, the connectors need not however be coated. The mesh construction of the connectors permits the connectors to be used in electrolytic cells adapted for the flow of electrolyte longitudinally through the cells. The electrolyte can flow past the connectors without being substantially impeded. An example of such a cell is one for the production of a chlorate. A preferred metal for the support connectors is a valve metal, such as titanium, which is dimensionally stable in an electrolytic cell.

The specific shape of the connectors 40, 42, 44 and 46 can vary as long as the leaf arms 50, 52, are of sufficient length to provide connector flexibility. In the embodiment illustrated in FIGS. 1-3, the connectors, in a non-stressed condition, have leaf arms 50, 52 which form an angle of approximately 6° relative to a mid-lane bisecting each connector. The arms 50, 52 have a zigzag configuration which includes an intermediate leg 56 (FIG. 3). The flattened ends 54 extend outwardly making an angle of about 105° with respect to the intermediate legs 56.

The arrangement of connectors 40, 42, 44 and 46, in the anode assembly of FIGS. 1-3, is in the nature of a flexible truss support, as mentioned, similar to a bridge support. The connectors for each anode sheet, as in a bridge support, maintain each sheet in a generally flat profile. For instance, with regard to anode sheet 20, the support for this sheet comprises leaf arm 50' (FIG. 3) of connector 42 and leaf arm 50" of connector 46. Each leaf arm 50', 50" extends the full width of the sheet 20 (parallel to riser 14), and is rigidly fastened to the sheet 20 at a plurality of weld points spaced-apart along a line parallel to riser 14. The leaf arms 50', 50" are relatively stiff, in a width-wise direction, due to the bends in the zigzag configuration of the arms. This provides a relatively rigid support which resists deflection of the sheet 20, widthwise, from a generally flat profile. At the bottom, close to gap 28, FIG. 3, the sheet 20 is attached to the flattened end 54 of connector 42. Near the top 34 of the assembly, the sheet 20 is attached to the flattened end 54 of connector 46. Since the connectors 42, 46 have essentially the same configuration, and thus stiffness in leaf arms 50', 50", the deflection or movement of the sheet 20 heightwise, from top to bottom, for whatever reason, will be about the same. The result is that when the sheet 20 is caused to move, for instance due to contact of the anode assembly with an adjacent cathode, it maintains its generally flat profile, in essence floating in its contraction movement. Similarly, when allowed to expand from an initial contracted condition, established to permit insertion of the anode assembly in an electrolytic cell, the anode sheets of the anode assembly float outwardly, until the anode assembly is fully expanded, or until an anode sheet is prevented from further expansion by a cathode. The result is that the anode sheets maintain during movement not only a generally flat profile, but in addition, a planar orientation which is essentially parallel with the orientation of other anode sheets of the assembly.

The anode assembly 12 of FIGS. 1-3 also comprises an array of insulating spacer buttons 60 of a dielectric material, such as polyvinylidene fluoride (Kynar), polytetrafluoroethylene, and fluorinated ethylene propylene, which is resistant to conditions within the electrolytic cell. The insulating spacer buttons permit use of the anodes of the present invention in an electrolytic cell for the production of chlorates. In a conventional chlorine or caustic producing electrolytic cell, Nafion membranes are generally positioned between the anodes and cathodes. These membranes insulate the anodes from the cathodes. The membranes are not required in an electrolytic cell for the production of a chlorate. This requires use of a special spacing or insulating means. In the embodiment of FIGS. 1-3, each anode sheet 20-26 has an array of eight (8) spacer buttons 60. The spacer buttons are dimensioned to extend a sufficient distance from the outer surface of each anode sheet so that an adjacent cathode is contacted by at least on spacer button rather than a surface of an anode sheet. This maintains a small gap between each anode sheet and an adjacent cathode, sufficient to prevent shorting of an anode to a cathode. Each insulating spacer button 60 can be a single piece extending through a perforation of a sheet, having compressible enlarged ends which releasably engage the opposite sides of a sheet and hold the spacer buttons in position. Alternatively, the spacer buttons can be two piece members such as a rivet with enlarged heads engaging opposite sides of a sheet. The array of eight (8) spacer buttons is arranged across the face of a sheet strategically positioned so that contact with a cathode is prevented even though a cathode may be relatively badly warped.

In addition to spacer buttons 60, each sheet has along its edge, adjacent gaps 28, 30, an insulation channel 62, (FIG. 3). The insulation channels 62 provide additional protection against shorting with a cathode and in addition prevent an edge of one sheet from locking with an edge of an adjacent sheet during compression of an anode assembly. The channels 62 also function to stiffen the edges of the anode sheets 20–26 adjacent to the gaps 28, 30. Additional stiffening of the sheets is provided by lips 36 formed at the edges of the sheets adjacent the bottom 32 of the assembly and the top 34 of the assembly.

Advantages of the invention should be apparent. By dividing each anode surface of an anode assembly into at least two individually movable sheets, and supporting each sheet so that it maintains a relatively flat profile, the individual sheets can be held in planes more parallel to the opposing surface of a cathode than is possible if a surface comprised only a single sheet. This in turn provides a more uniform anode to cathode gap and a more uniform current distribution across the face of an anode. Fewer hot spots are likely. In addition, the present invention allows each sheet to be positioned generally closer to an adjacent cathode without shorting than is possible if a sheet were more flexible.

In manufacturing the anode assembly of FIGS. 1–3, the V-shaped connectors 40, 42 are first welded to diametrically opposite sides of the anode riser 14. Preferably, they are joined to the riser 14 by a series of closely-spaced spot welds which provide both structural integrity and suitable electrical conductivity. The welding can be accomplished according to the process and with the apparatus disclosed in U.S. Pat. No. 4,033,849. The disclosure of this patent is incorporated herein by reference. In essence, welding electrodes are reciprocated inwardly from opposite sides of the riser to form the necessary welds. Preferably, at least every other strand or ribbon of a titanium mesh connector is joined to the riser 14. During the welding, the connectors can be held by jigs which maintain the connector surfaces parallel with the axis of the riser 14. Thereafter, the preformed anode sheets 20, 22, 24 and 26 are joined to the connectors 40, 42. Preferably this is also accomplished by a series of spot welds which electrically and structurally connect the connectors 40, 42 to the anode sheets. To carry out this welding operation, heavy copper conductor bars are temporarily positioned between the ends 54 of the connectors and welding electrodes are reciprocated against the anode sheets to complete the welding. A similar sequence of steps can be carried out with regard to welding the second pair of support connectors 44, 46 to the anode sheets.

Although the anode assembly 12 of FIGS. 1–3 contains four independently movable anode sheets, the assembly can comprise more than four sheets if desired. For instance, a sheet can further be segmented along its width, defining a separation gap from top to bottom about midway between opposite sides of the sheet. Similarly, a sheet can be segmented from top to bottom by providing a gap about midway between the top and bottom of each sheet. In this latter embodiment, the sheet furthermost removed from the assembly riser 14 can be connected to the riser by a support connector similar broadly in configuration to the support connectors 40, 42, but having leaf arms substantially longer than the leaf arms 50, 52 and positioned inside of the leaf arms 50, 52. Also, in the embodiment of FIGS. 1–3, the surfaces 16, 18 are segmented widthwise so that the gaps 28, 30 between adjacent sheets are parallel with riser 14. As an alternative, the surfaces could be segmented in a vertical direction so that the gaps between adjacent sheets are perpendicular to the riser 14.

Figure 4:
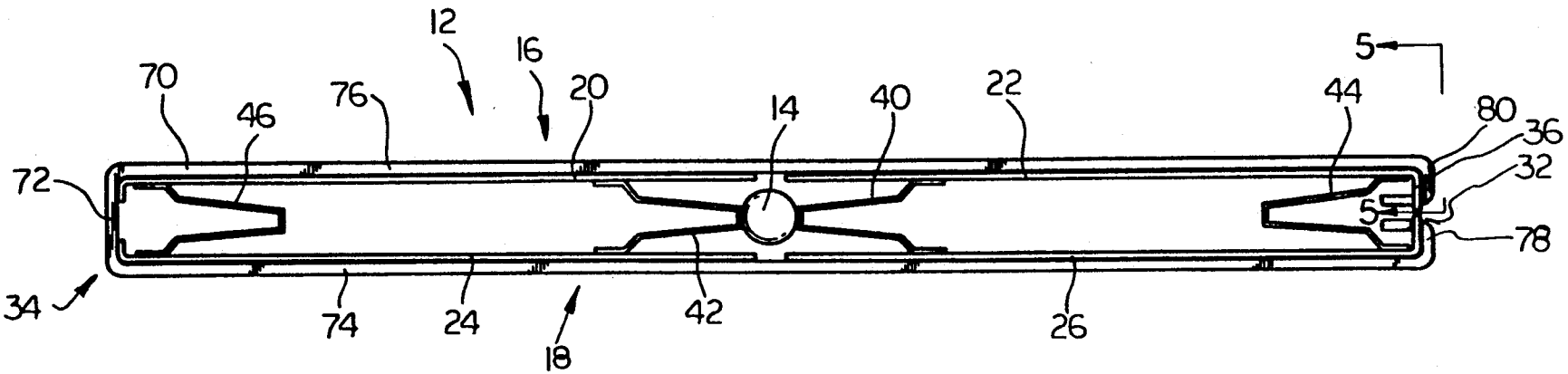
FIG. 4 is a plan view of an anode assembly in accordance with an embodiment of the present invention.
Figure 6:
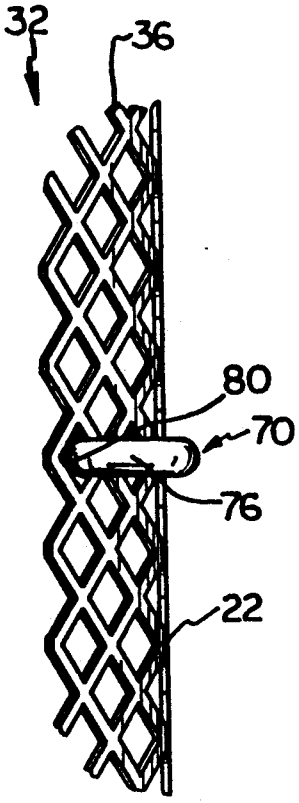
FIG. 6 is an enlarged section view taken along line 6—6 of FIG. 4.
Figure 5:
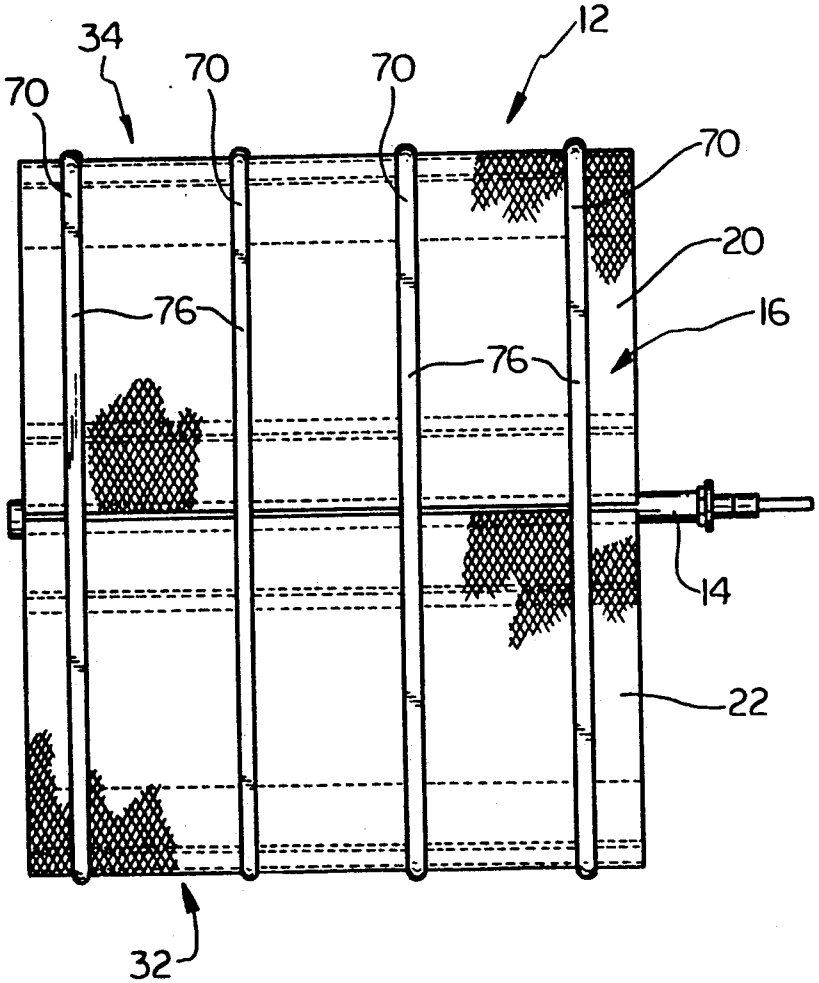
FIG. 5 is a reduced elevation view of the anode assembly of FIG. 4.

FIGS. 4 and 5 illustrate an embodiment of the present invention. In this embodiment, instead of insulating spacer buttons 60, the anode assembly comprises a plurality of hairpin rods 70 which extend around the assembly. As shown in FIG. 4, each hairpin rod 70 comprises a middle section 72 adjacent the assembly upper edge 34, legs 74 and 76 which depend from the middle section 72, and hook ends 78, 80, adjacent the assembly lower edge 32, at the ends of legs 74, 76. The hairpin rods are made of a flexible, plastic, dielectric material, such as polyvinylidene fluoride (Kynar), polytetrafluoroethylene, and fluorinated ethylene propylene, which is resistant to conditions within an electrolytic cell. By way of example, each hairpin rod may have a diameter or width of about one-eighth inch. In the embodiment of FIGS. 4 and 5, four hairpin rods 70 (FIG. 5) are spaced laterally around each anode assembly and are strategically positioned to prevent contact and shorting of the anode assembly with a cathode. Each hairpin rod, as shown in FIG. 4, is placed over the outside of the anode assembly with the middle section 72 against the top 34 of the assembly. The ends 78 and 80 are easily deformable and can be bent so that they extend upwardly into the spacing between the anode sheets at the bottom 32 of the assembly. When bent, and inserted into the spacing between the anode sheets, they extend upwardly and penetrate an open space in the expanded metal mesh of an anode lip 36, as shown in FIG. 4 and FIG. 6. One end 78 engages the anode lip 36 of anode 26, and the other end 80 engages the other anode lip 36 of anode 22. The openings in the expanded metal mesh are about one-eighth inch in diameter, and thus readily accept the rod ends 78, 80. The ends 78 and 80 have a tendency to straighten out, and thus frictionally lock into the openings in the expanded metal mesh. By locking with the expanded metal mesh, the rods become firmly fastened to the anode assembly. The hairpin rods have sufficient flexibility that they allow floating movement of the anode sheets in the manner described above with respect to the embodiment of FIGS. 1–3. In other words, the anode assembly can be compressed so that it can be installed within an electrolytic cell. Following compression, the anode sheets can float outwardly, relatively independently, maintaining a substantially flat profile, to establish essentially, a uniform "minimum-gap" with an adjacent cathode.

From the above description of preferred embodiments of the invention, those skilled in the art will perceive improvements, changes and modifications. Each improvement, change and modification within the skill of the art is intended to be covered by the appended claims.

What is claimed is:

1. An expandable electrode assembly for an electrolytic cell comprising:

an electrode riser;

first and second spaced-apart active electrode surfaces on opposite sides of said electrode riser;

each electrode surface comprising multiple electrode sheets;

similarly configured spring connectors supporting said electrode sheets, said spring connectors allowing movement of one sheet of an electrode surface without movement of the other sheet of said surface, each sheet being supported by a first connector which makes a first linear connection with an electrode sheet and a second connector which makes a second linear connection with said sheet, said linear connections being spaced apart from each other and from edges of each electrode sheet distances which are effective to hold said sheet so that each sheet profile remains essentially flat in such movement, each sheet lying in the same or essentially a parallel plane with other sheets of the electrode assembly in such movement.

2. The electrode assembly of claim 1 wherein each electrode sheet is supported by two spring connectors, said spring connectors being in the shape of a leaf spring and deformable in essentially the same direction.

3. The electrode assembly of claim 2 having a width dimension parallel to the riser wherein said first connector extends from the riser to the sheet and is at least substantially coextensive with the width dimension of the sheet, said second connector extending between a sheet of said first surface, on one side of the riser, and a sheet of said second surface, on the opposite side of the riser, said second connector also being at least substantially coextensive with said sheet.

4. The electrode assembly of claim 3 wherein each connector has a zig-zag cross-section providing rigidity widthwise with respect to said sheet.

5. The electrode assembly of claim 4 wherein each electrode sheet comprises a lip along a bottom or top edge at right angles to the plane of the sheet providing additional rigidity widthwise of the sheet.

6. The electrode assembly of claim 3 wherein said connectors are perforate or made of expanded metal mesh.

7. The electrode assembly of claim 6 wherein said connectors are welded to said riser and electrode sheets by resistance welding at a plurality of points.

8. The electrode assembly of claim 6 including insulation means positioned on said electrode sheets to prevent contact of an electrode sheet with a cathode.

9. The electrode assembly of claim 8 wherein said insulation means comprises a plurality of spacer buttons of a dielectric material, each electrode sheet supporting an array of spacer buttons positioned and dimensioned to maintain a gap between said sheet and an adjacent cathode.

10. The electrode assembly of claim 8 wherein said insulation means comprises a plurality of elongate rods of a dielectric material, said rods having a hairpin configuration which wraps around the electrode assembly with rod ends which are bent and extend into spacing between opposed sheets of the assembly, said ends protruding through perforations of and engaging the mesh of said electrode sheets.

11. The electrode assembly of claim 6 for use as an anode in an electrolytic process comprising anode sheets which are of a coated metal which is at least substantially non-consumable in the electrolytic process in which the electrode assembly is used.

12. The electrode assembly of claim 1 for use in an electrolytic process wherein said electrode sheets are coated metal sheets which are dimensionally stable in said electrolytic process.

13. A minimum-gap anode assembly for an electrolytic cell comprising:

an elongated anode riser;

anode surfaces in generally parallel planes on opposite sides of said riser;

each anode surface comprising multiple anode sheets;

spring support means resiliently supporting said anode sheets for floating movement of one sheet of an anode surface independent of other sheets of said anode surface, said spring support means comprising a first spring support comprising a shape of a leaf spring making a first linear connection with an electrode sheet and a second spring support comprising a shape of a leaf spring configured similar to said first spring support making a second linear connection with an electrode sheet, said linear connections being spaced apart from each other and from the edges of said electrode sheet distances which are effective to hold said sheet in a flat profile, with at least one of said supports electrically connecting said sheet with said riser.

14. The assembly of claim 13 for a chlorate producing electrolytic cell.

15. The assembly of claim 14 wherein said spring support means are perforate or made of expanded metal mesh, each sheet comprising a plurality of dielectric spacers adapted to maintain a gap between a sheet and an adjacent cathode.

16. The assembly of claim 15 wherein said dielectric spacers comprise a plurality of spacer buttons of a dielectric material, each anode sheet supporting an array of spacer buttons positioned and dimensioned to maintain a gap between said sheet and an adjacent cathode.

17. The assembly of claim 15 wherein said dielectric spacers comprise a plurality of elongate rods of a dielectric material, said rods having a hairpin configuration which wraps around said anode surfaces with rod ends which are bent and extend into the spacing between opposed sheets of said surfaces, said ends protruding through perforations of and engaging the mesh of said anode sheets.

18. The assembly of claim 13 wherein each anode surface comprises two anode sheets which are normally coplanar.

19. In a membrane-free electrolytic cell which comprises:

a plurality of cathodes; and a plurality of anode assemblies in alternating sequence with said cathodes;

wherein the improvement of each anode assembly comprises:

(i) an elongated anode riser;

(ii) spaced-apart anode surfaces in generally parallel planes on opposite sides of said riser;

(iii) each anode surface comprising multiple anode sheets;

(iv) spring support means resiliently supporting said anode sheets for floating movement of one sheet of an anode surface independent of other sheets of said anode surface, said spring support means comprising a first spring support comprising a shape of a leaf spring making a first linear connection with an electrode sheet and a second spring support comprising a shape of a leaf spring configured similar to said first spring support making a second linear connection with an electrode sheet, said linear connections being spaced apart from each other and from the edges of said electrode sheet distances which are effective to hold said sheet in a flat profile, with at least one of said supports electrically connecting said sheet with said riser.

20. In the cell of claim 19 wherein each sheet comprises a plurality of dielectric spacers adapted to maintain a gap between a sheet and an adjacent cathode.

21. In the cell of claim 20 wherein said dielectric spacers comprise a plurality of spacer buttons of a dielectric material, each anode sheet supporting an array of spacer buttons positioned and dimensioned to maintain a gap between said sheet and an adjacent cathode.

22. In the cell of claim 20 wherein said dielectric spacers comprise a plurality of elongate rods of a dielectric material, said rods having a hairpin configuration which wraps around the anode assembly with rod ends which are bent and extend into spacing between opposed sheets of the assembly, said ends protruding through perforations of and engaging the mesh of said anode sheets.

23. The cell of claim 22 for producing a chlorate.

24. The cell of claim 19 wherein each anode surface comprises two anode sheets which are normally co-planar.

* * * * *

UNITED STATES PATENT AND TRADEMARK OFFICE

CERTIFICATE OF CORRECTION

PATENT NO. : 5,100,525

DATED : March 31, 1992

INVENTOR(S) : Pohto et al

It is certified that error appears in the above-identified patent and that said Letters Patent is hereby corrected as shown below:

In Claim 1, column 9, line 17 of the Patent, delete "from" before "edges" and substitute --in relation to-- therefor.

In Claim 13, column 10, line 24 of the Patent, delete "from" before "the edges" and substitute --in relation to-- therefor.

In Claim 19, column 11, line 6 of the Patent, delete "from" before "the edges" and substitute --in relation to-- therefor.

Signed and Sealed this

Thirteenth Day of July, 1993

*Attest:*

Michael K. Kirk

MICHAEL K. KIRK

*Attesting Officer*

*Acting Commissioner of Patents and Trademarks*